US005689991A

United States Patent [19]

Kircher

[11] Patent Number: 5,689,991

[45] Date of Patent: Nov. 25, 1997

[54] PROCESS AND DEVICE FOR PRODUCING HOT-ROLLED STEEL STRIP

[75] Inventor: Werner Kircher, Ratingen, Germany

[73] Assignee: Mannesmann Aktiengesellschaft, Düsseldorf, Germany

[21] Appl. No.: 624,786

[22] Filed: Mar. 27, 1996

[30] Foreign Application Priority Data

Mar. 28, 1995 [DE] Germany ..... 195 12 953.9

[51] Int. Cl.[6] ..... B21B 27/06

[52] U.S. Cl. ..... 72/202; 72/229; 29/527.7

[58] Field of Search ..... 72/202, 203, 206, 72/227, 229, 230, 231, 365.2; 29/527.7

[56] References Cited

U.S. PATENT DOCUMENTS

| | | | |
|---|---|---|---|
| 4,319,474 | 3/1982 | Gronbech | 72/231 |
| 4,348,882 | 9/1982 | Tippins | 72/229 |
| 4,503,697 | 3/1985 | Tippins et al. | 72/229 |
| 4,675,974 | 6/1987 | Connolly | 72/229 |
| 4,782,683 | 11/1988 | Tippins et al. | 72/229 |
| 5,150,597 | 9/1992 | Sekiya et al. | 72/229 |
| 5,414,923 | 5/1995 | Thomas et al. | 29/527.7 |
| 5,430,930 | 7/1995 | Passoni et al. | 29/527.7 |
| 5,467,519 | 11/1995 | Tippins et al. | 29/527.7 |
| 5,511,303 | 4/1996 | Tippins et al. | 29/527.7 |
| 5,560,095 | 10/1996 | Kruger | 29/527.7 |

FOREIGN PATENT DOCUMENTS

| | | | |
|---|---|---|---|
| 0584605 | 3/1994 | European Pat. Off. | 72/229 |
| 6269805 | 9/1994 | Japan | 72/229 |

*Primary Examiner*—Lowell A. Larson
*Assistant Examiner*—Ed Tolan
*Attorney, Agent, or Firm*—Cohen, Pontani, Lieberman & Pavane

[57] ABSTRACT

A process for producing hot-rolled steel strip from strip-form cast feedstock in consecutive work steps, in which the solidified feedstock is roughed down in a particular sequence by reversing roll passes. The feedstock is then coiled up for temporary storage in a furnace atmosphere, and finally supplied to a finishing train to be rolled down to the finished band thickness. The machine for carrying out this process includes a temperature-controlled intermediate storage furnace provided between a reversing Steckel mill and the multi-stand finishing train.

6 Claims, 2 Drawing Sheets

PROCESS AND DEVICE FOR PRODUCING HOT-ROLLED STEEL STRIP

BACKGROUND OF THE INVENTION

1. Field of the Invention

The invention relates to a process for producing hot-rolled steel strip from strip-form cast feedstock in consecutive work steps, whereby the solidified feedstock, divided into lengths of roughed strips heated to roll temperature, is rolled down in a reversing Steckel mill with upstream and downstream Steckel furnaces as well as in an attached multi-stand finishing train.

2. Description of the Prior Art

A process and a machine of the above-discussed type are known from EP 04 49 004 A2. The process described in this reference proposes, particularly for rolling high-quality steel strips, that the rolling process be divided into a roughing step and a finishing step, with the roughing step being carried out in a reversing Steckel mill. On the entrance side and on the exit side of the Steckel mill, there is what is called a Steckel furnace, in which the rolling material, after having passed through the Steckel mill, can be coiled and uncoiled and its temperature can be controlled at the same time. The finish-rolling is carried out in a three-stand or multi-stand tandem finishing train, to which the rolling material is supplied after several reversing roll steps have been carried out in the Steckel mill.

With a machine of this type, it is disadvantageous that the finishing train, which is located directly downstream from the reversing Steckel mill, cannot be used for rolling while the reversing Steckel mill is in operation, because the two rolling steps, i.e., the roughing step and the finishing step are connected to one another, as are the corresponding parts of the unit. Although the known train is able to function with a low number of stands, the advantage of lower investment costs that this low number of stands brings is offset by the disadvantage of lower machine capacity.

SUMMARY OF THE INVENTION

Starting from the known prior art, it is accordingly an object of the present invention to provide a process for producing hot-rolled steel strip from strip-form cast feedstock, as well as a corresponding machine with a low number of stands, i.e., low investment costs, with which it is possible to produce finished strip at higher productivity and more economically than previously possible.

Pursuant to this object, one aspect of the present invention resides in roughing down the cast feedstock that is 80 to 150 mm thick to a thickness of from 7 to 20 mm, after its surface is descaled, in five to seven reversing roll passes, whereby it is first pre-reduced in three to five reversing passes in the Steckel mill with free run-out, and then is further reduced in further reversing roll passes in the Steckel mill with the use of the downstream and upstream Steckel furnaces. After the final roughing pass, the feedstock is coiled up for storage in a furnace atmosphere at a coiling-and-uncoiling station in front of the finishing train. From here the feedstock, which has been brought to the rolling temperature, is supplied to the finishing train to be rolled down to the thickness of the finished strip.

In the first reversing roll passes with free run-out, relatively thick feedstock can be reduced to such an extent that it can be coiled in the Steckel furnaces, so as to then undergo further reducing passes after leaving the Steckel furnaces, in the known manner of a reversing Steckel mill, and then be wound into a coil in a furnace atmosphere. In this way, the roughed strip rolled down from the continuously-cast feedstock is completely disconnected from the downstream finishing train, making it possible to supply the finishing train from the second of the coiling and uncoiling stations used as storage devices and to do this at the same time as the feedstock is being rolled in the roughing train (reversing Steckel mill). As a result, the dead times of the finishing train are eliminated and the unit can thus be used more intensively, so that higher capacity can be expected.

In a further embodiment of the invention, 90 to 100 mm thick cast feedstock is rolled down in three reversing passes in the Steckel mill with free run-out to a thickness of less than 30 mm. Then, the feedstock is further reduced in two further reversing roll passes with the use of the downstream and upstream Steckel furnaces, and, after the fifth roll pass in the Steckel mill, the feedstock is coiled at a coiling and uncoiling station, from where the feedstock is supplied to the finishing train to be rolled down to the thickness of the finished strip. At the indicated feedstock thickness, three reversing roll passes with free run-out are sufficient to achieve a coilable strip. Care must simply be taken to ensure that the spacing in front of and behind the Steckel mill corresponds to the length of roughed strip after the second pass and thus permits the free run-out of the roughed strip length. After the third pass, the roughed strip is coiled up in the Steckel furnace so that the length of roughed strip is temporarily stored. Only after the fifth pass in the Steckel mill is the beginning of the rolled-down roughed strip conveyed to the coiling-and-uncoiling station and there wound into a coil within a furnace atmosphere. After the coil is changed around, the roughed strip is supplied to the finishing train in the uncoiled state, with the advantage that the head-end of the coiled roughed strip becomes the foot-end when it is uncoiled. As a result, better temperature compensation conditions are created, which mean better rolling results.

In an advantageous pass sequence, the feedstock is rolled down in the first reversing pass to 60 to 70 mm, preferably 65 mm; in the second reducing pass to 35 to 45 mm, preferably 40 mm; in the third to 20 to 30 mm, preferably 25 mm; in the fourth reversing pass to 12 to 22 mm, preferably 17 mm, and in the fifth reversing pass to 7 to 17 mm, preferably 12 mm; and—after being temporarily stored—is finish-rolled in the finishing train to <2 mm, preferably 1 mm.

Preferably, the capacity of the reversing Steckel mill and the finishing train are designed so that the rolling times and thus the production quantity are essentially the same.

In a further embodiment of the invention, a process for producing hot-rolled steel strip from feedstock cast in strip form on two or more parallel casting machines is proposed. In this process, in order to connect the casting machines, the feedstock of at least one casting machine is, after being divided into lengths of roughed strip and prior to the reversing pass, moved crosswise in line with the reversing Steckel mill.

Another aspect of the present invention resides in an apparatus for producing hot-rolled steel strip from strip-form east feedstock in consecutive work steps, which apparatus is comprised of a curved continuous casting machine with horizontal run-out, a cross-cutting device for separating the solidified feedstock into lengths of roughed strip, a compensation furnace for heating the feedstock to rolling temperature, a reversing Steckel mill with upstream and downstream Steckel furnaces, and an attached multi-stand finishing train for carrying out the previously discussed process. A temperature-controlled intermediate storage furnace with a coiler is provided between the reversing Steckel mill and the multi-stand finishing train for coiling the roughed strip after it leaves the reversing Steckel mill and for uncoiling the roughed strip prior to its introduction into the multi-stand finishing train. The temperature-controlled intermediate storage furnace with a coiler disconnects the roughing rolling from the finish-rolling and permits the simultaneous operation of both machine parts.

The invention creates a simple and economical machine for producing finished strip, which provides, with a low number of stands, i.e., low investment costs, a high unit capacity, which is based on the greater availability of the train that results from the disconnection of the roughing train and the finishing train.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
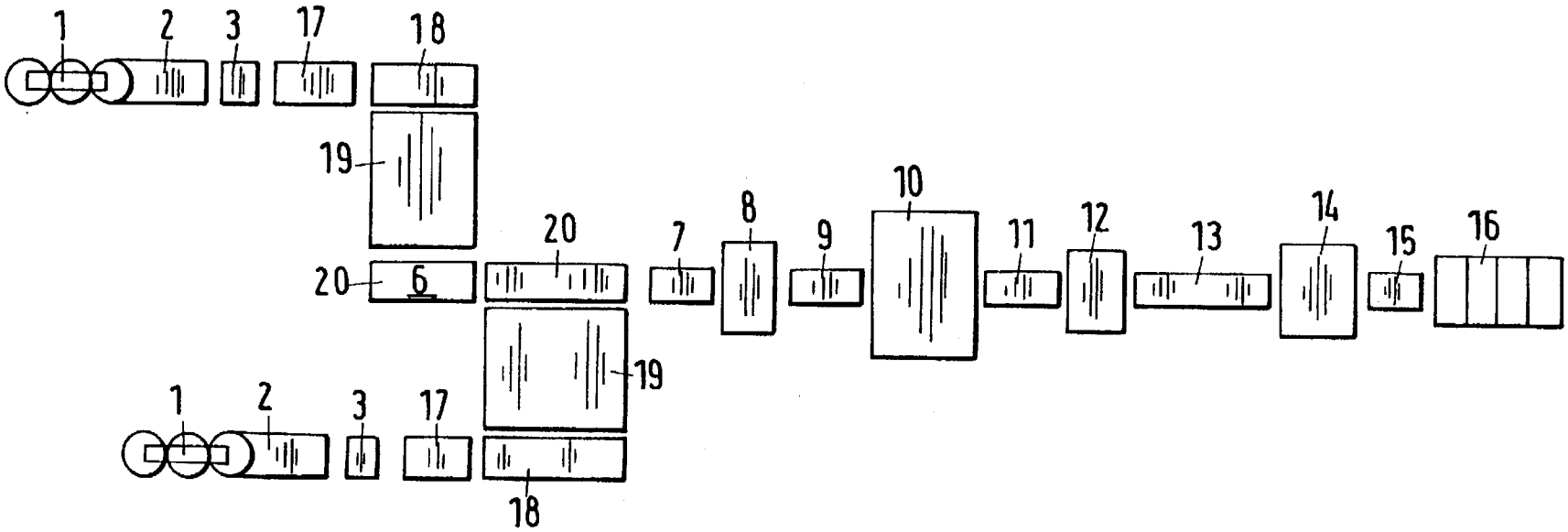
FIG. 1 schematically illustrates a first embodiment of the invention.

FIG. 1 shows a ladle turning tower 1, which is upstream from a continuous casting machine 2 and supplies the casting machine 2 with casting melt. The continuous casting machine 2 is designed as a curved continuous casting machine with horizontal run-out and has at its exit-side end a flame cutting machine or shears 3 which divide the continuously cast strip of feedstock into lengths of roughed strip. These roughed strip lengths are conveyed via a roller table 17 to an entrance roller table 18. From the roller table 18, the strip lengths are conveyed by means of an entrance device into a walking-beam furnace 19, where they are brought to a uniform temperature over their cross-section. After heating, the strip lengths are placed by an extraction device onto an extraction roller table 20, to then be supplied, after descaling in a scale scrubber 7, to a Steckel mill 10. Three rolling passes are carried out in the Steckel mill 10, without the Steckel furnaces 8, 12 which are arranged before and after the Steckel mill 10, being used. Free run-out of the roughed strip lengths which results from the rolling passes follows onto the roller tables 13, 6. After the third roll pass in the Steckel mill 10, the rolled-down roughed strip is coiled in the Steckel furnace 12, and after the foot-end has passed through the Steckel mill 10, it is uncoiled through the Steckel mill 10. After this, it is coiled in the Steckel furnace 8. After being uncoiled from the Steckel furnace 8 and rolled in the Steckel mill 10 in a fifth roll pass, the roughed strip is coiled up in a temporary storage device 14. After the roughed strip length is coiled up in the coiling-and-uncoiling station and the coil is turned, uncoiling is carried out from this area into a finishing train 16, with, if desired, descaling first being carried out in a scaling scrubber 15. In addition, shears can be arranged between the intermediate storage device 14 and the finishing train 16. While the roughed strip is being uncoiled from the intermediate storage device 14, a new roughed strip can be rolled-down in the roughing train, so that the roughing train and the finishing train 16 can be operated simultaneously.

Figure 2:
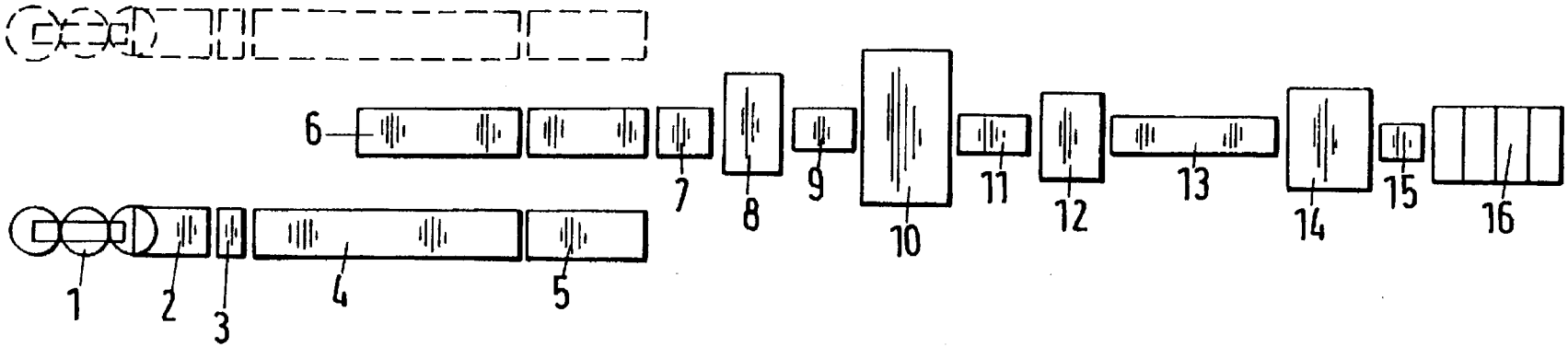
FIG. 2 schematically illustrates a second embodiment of the invention.

In FIG. 2, the same parts are given the same reference numbers. The ladle turning tower 1 is located upstream from the continuous casting machine 2 and supplies the latter with casting melt. The continuous casting machine 2, which is designed as a curved continuous casting machine with horizontal run-out, has at its run-out end a flame cutting machine 3, with the help of which the continuously cast feedstock strip is divided into lengths of roughed strip. These roughed strip lengths are conveyed into a roller hearth furnace 4, where they are brought to a uniform temperature over their cross-section. By means of a ferrying device 5 arranged on the exit side of the roller hearth furnace 4, a roughed strip length is brought into the roll line, in order to be supplied, after descaling in the scale scrubber 7, to the Steckel mill 10. Three roll passes are carried out in the Steckel mill 10 with free run-out of the roughed strip length onto the roller tables 13, 6, without the Steckel furnaces 8, 12 being used. After a third roll pass in the Steckel mill 10, the rolled-down roughed strip is coiled up in the Steckel furnace 12, and after the foot-end has passed through the Steckel mill 10, it is uncoiled through the Steckel mill 10, and after this it is coiled up in the Steckel furnace 8. After being uncoiled from the Steckel furnace 8 and rolled in a fifth roll pass in the Steckel mill 10, the roughed strip is coiled up in the intermediate storage device 14. After the roughed strip length is coiled up at one of the coiling-and-uncoiling stations and the coil is turned, uncoiling is carried out from this area into the finishing train 16, whereby, if desired, descaling is first carried out in the scale scrubber 15. In addition, shears can be arranged between the storage device 14 and the finishing train 16. While the roughed strip is being uncoiled from the storage device 14, a new roughed strip can be rolled-down in the roughing train, so that the roughing train and the finishing train can be operated at the same time.

As shown by the broken line in FIG. 2, the machine can also be executed as a twin-strand continuous casting machine, with the ferrying device 5 connecting both strands of the casting machine to the roll line.

In an advantageous pass sequence, for example, a 100 mm thick slab is cut to length in the flame cutting device 3, conveyed through the roller hearth furnace 4 and brought to the necessary temperature; it is then conveyed by the ferrying device 5 into the roll line. The first two roll passes are carried out without use of the Steckel furnaces 8, 12. In the first pass, the slab is reduced to 65 mm, in the second pass to 40 mm, and in the third pass to 25 mm. After the third pass, the slab that has been rolled down into a roughed strip is conveyed into the Steckel furnace 12, where it is coiled up. The fourth pass utilizes the Steckel furnace 8 on the other side of the Steckel mill 10, in which the roughed strip that has in the meantime been reduced to 17 mm is coiled up. After the roughed strip is uncoiled and again reduced in the Steckel mill 10, the roughed strip, now reduced to 12 mm is, after the fifth pass, coiled up in the storage device 14, from where it is supplied to the finishing train 16. In the finishing train 16, a finished strip of a minimum of 1 mm is produced in, for example, four stands.

The spacing and lengths of the individual components of the machines are selected in such a way that there is no reciprocal interference between the working procedures, so that the entire rolling process takes place quickly, with extremely low temperature losses, and without dead times.

The invention is not limited by the embodiments described above which are presented as examples only but can be modified in various ways within the scope of protection defined by the appended patent claims.

I claim:

1. A process for producing hot-rolled steel strip from a strip-form cast feedstock, comprising the consecutive steps of:

dividing cast feedstock having a thickness of 80 to 150 mm into lengths of roughed strip;

heating the roughed strip to roll temperature;

rolling down the heated, descaled roughed strip in a reversing Steckel mill having upstream and downstream Steckel furnaces, the rolling including roughing down the strip in five to seven reversing roll passes to a thickness of 7–20 mm, pre-reducing being first carried out in three to five reversing roll passes in the Steckel mill with free run-out, and subsequently further reducing being carried out in further reversing roll passes in the Steckel mill using the downstream and upstream Steckel furnaces;

after a final roughing pass, coiling the strip in one of two coiling-and-uncoiling stations arranged in front of a finishing train, for temporarily storing the strip at rolling temperature in a furnace atmosphere of a temporary storage furnace;

supplying the strip from the coiling and uncoiling station to the finishing train so that a new length of feedstock can be fed to the Steckel mill during uncoiling of the strip from the storage furnace; and finish rolling the strip down to a finished strip thickness in the finishing train.

2. A process as defined in claim 1, wherein the cast feedstock has a thickness of 90 to 100 mm, the rolling step including rolling the cast feedstock down in three reversing roll passes in a reducing manner in the Steckel mill with free run-out to a thickness of less than 30 mm and further reducing the feedstock in two further reversing roll passes using the downstream and upstream Steckel furnaces, the coiling step taking place after fifth roll pass in the Steckel mill.

3. A process as defined in claim 2, wherein the rolling step includes rolling down the feedstock in the first reversing roll pass to 60–70 mm, rolling the feedstock down in the second reversing roll pass to 35–45 mm, rolling the feedstock down in the third reversing roll pass to 20–30 mm, rolling the feedstock down in the fourth reversing roll pass to 12–22 mm, and in the fifth reversing pass rolling the feedstock down to 7–17 mm, and, the finish-rolling step including finish-rolling to less than 2 mm.

4. A process as defined in claim 3, wherein the rolling step includes rolling down the feedstock in the first reversing roll pass to 65 mm, rolling the feedstock down in the second reversing roll pass to 40 mm, rolling the feedstock down in the third reversing roll pass to 25 mm, rolling the feedstock down in the fourth reversing roll pass to 17 mm, and rolling the feedstock down in the fifth reversing roll pass to 12 mm, the finish-rolling step including finish rolling the feedstock to 1 mm.

5. A process for producing hot-rolled steel strip from strip-form cast feedstock supplied from at least two parallel casting machines, comprising the steps of:

dividing cast feedstock having a thickness of 80 to 150 mm into lengths of roughed strip;

heating the roughed strip to roll temperature;

rolling down the heated, descaled roughed strip in a reversing Steckel mill having upstream and downstream Steckel furnaces, the rolling including roughing down the strip in five to seven reversing roll passes to a thickness of 7–20 mm, pre-reducing being first carried out in three to five reversing roll passes in the Steckel mill with free run-out, and subsequently further reducing being carried out in further reversing roll passes in the Steckel mill using the downstream and upstream Steckel furnaces;

after a final roughing pass, coiling the strip in one of two coiling-and-uncoiling stations arranged in front of a finishing train, for temporarily storing the strip in a furnace atmosphere at rolling temperature;

supplying the strip from the coiling and uncoiling station to the finishing train;

finish rolling the strip down to a finished strip thickness in the finishing train; and supplying the lengths of roughed strip from one of the casting machines to the reversing Steckel mill.

6. An apparatus for producing hot-rolled steel strip from strip-form cast feedstock, comprising:

a curved continuous casting machine with horizontal run-out;

cross-cutting means arranged at the run-out of the casting machine for separating solidified feedstock into lengths of roughed strip;

compensating furnace means arranged downstream of the cross-cutting means for heating the feedstock to a rolling temperature;

a reversing Steckel mill arranged downstream of the compensating furnace means and including upstream and downstream Steckel furnaces for rolling the strip;

a multi-stand finishing train arranged downstream of the Steckel mill;

a temperature-controlled temporary storage furnace between the reversing Steckel mill and the multi-stand finishing train, the temporary storage furnace including coiler means for coiling up the roughed strip after it leaves the reversing Steckel mill and for uncoiling the roughed strip prior to introduction into the multi-stand finishing train.

* * * * *